US007152343B2

(12) United States Patent
Whatley

(10) Patent No.: US 7,152,343 B2
(45) Date of Patent: Dec. 26, 2006

(54) FOOTWEAR SYSTEM

(75) Inventor: Ian Whatley, Greenville, SC (US)

(73) Assignee: Cronus, Inc., Wyckoff, NJ (US)

( * ) Notice: Subject to any disclaimer, the term of this patent is extended or adjusted under 35 U.S.C. 154(b) by 170 days.

(21) Appl. No.: 10/877,131

(22) Filed: Jun. 25, 2004

(65) Prior Publication Data

US 2005/0283999 A1 Dec. 29, 2005

(51) Int. Cl.
*A43B 13/20* (2006.01)

(52) U.S. Cl. ..... 36/29

(58) Field of Classification Search ..... 36/29, 36/35 B, 153, 154
See application file for complete search history.

(56) References Cited

U.S. PATENT DOCUMENTS

| | | | | | |
|---|---|---|---|---|---|
| 4,132,016 | A | | 1/1979 | Vaccari | 36/114 |
| 4,358,902 | A | * | 11/1982 | Cole et al. | 36/28 |
| 4,566,206 | A | | 1/1986 | Weber | 36/7.8 |
| 4,577,417 | A | | 3/1986 | Cole | 36/29 |
| 4,706,316 | A | | 11/1987 | Tanzi | 12/142 T |
| 4,741,114 | A | | 5/1988 | Stubblefield | 36/32 R |
| 4,771,554 | A | | 9/1988 | Hannemann | 36/27 |
| 4,881,329 | A | | 11/1989 | Crowley | 36/38 |
| 4,910,884 | A | | 3/1990 | Lindh et al. | 36/28 |
| 5,005,299 | A | | 4/1991 | Whatley | 36/25 R |
| 5,060,401 | A | | 10/1991 | Whatley | 36/25 R |
| 5,092,060 | A | * | 3/1992 | Frachey et al. | 36/29 |
| RE34,102 | E | * | 10/1992 | Cole et al. | 36/28 |
| 5,279,051 | A | | 1/1994 | Whatley | 36/25 R |
| 5,375,346 | A | | 12/1994 | Cole et al. | 36/29 |
| 5,416,986 | A | | 5/1995 | Cole et al. | 36/29 |
| 5,440,826 | A | | 8/1995 | Whatley | 36/25 R |
| 5,524,364 | A | | 6/1996 | Cole et al. | 36/29 |
| 5,545,463 | A | | 8/1996 | Schmidt et al. | 428/178 |
| 5,595,002 | A | | 1/1997 | Slepian et al. | 36/27 |
| 5,664,341 | A | | 9/1997 | Schmidt et al. | 36/28 |
| 5,678,328 | A | | 10/1997 | Schmidt et al. | 36/29 |
| 5,679,439 | A | | 10/1997 | Schmidt et al. | 428/178 |
| 5,701,687 | A | | 12/1997 | Schmidt et al. | 36/29 |
| 5,794,359 | A | | 8/1998 | Jenkins et al. | 36/28 |
| 5,806,209 | A | * | 9/1998 | Crowley et al. | 36/28 |
| 5,842,291 | A | | 12/1998 | Schmidt et al. | 36/29 |
| 5,896,608 | A | | 4/1999 | Whatley | 12/142 T |
| 5,926,974 | A | | 7/1999 | Friton | 36/28 |
| 5,956,869 | A | * | 9/1999 | Kim | 36/29 |
| 6,018,889 | A | | 2/2000 | Friton | 36/28 |
| 6,029,962 | A | | 2/2000 | Shorten et al. | 267/145 |
| 6,226,896 | B1 | | 5/2001 | Friton | 36/28 |
| 6,453,577 | B1 | * | 9/2002 | Litchfield et al. | 36/29 |
| 6,754,981 | B1 | * | 6/2004 | Edwards | 36/29 |

* cited by examiner

*Primary Examiner*—Ted Kavanaugh
(74) *Attorney, Agent, or Firm*—Ohlandt, Greeley, Ruggiero & Perle, L.L.P.

(57) ABSTRACT

A footwear system has a sole unit with a number of cavities formed between a midsole and an outsole. The cavities are complementary to one another to form groundward oriented air bulges in the outsole that are connected by a passage formed in the midsole. The passage permits movement of air between the cavities during use of the footwear system in a shoe.

27 Claims, 10 Drawing Sheets

FOOTWEAR SYSTEM

BACKGROUND OF THE INVENTION

1. Field of the Invention

The present invention relates to shoes. More particularly, the present invention relates to a shoe having a footwear system with an air bulge formed by a midsole and an outsole of the shoe.

2. Description of the Related Art

Shoes having cushioning members disposed under a wearer's foot are known in the art, for example U.S. Pat. No. 5,701,687 to Schmidt, U.S. Patent Nos. 5,896,608, 5,279,051, 5,060,401, 5,005,299, 5,440,826 to Whatley, U.S. Pat. No. 4,741,114 to Stubblefield, U.S. Pat. No. 4,706,316 to Tanzi, U.S. Pat. No. 4,132,016 to Vaccari, U.S. Pat. No. 5,595,002 to Slepian, U.S. Pat. No. 4,881,329 to Crowley, U.S. Pat. No. 4,566,206 to Weber, U.S. Pat. No. 4,771,554 to Hannemann, U.S. Pat. No. 4,910,884 to Lindh, U.S. Pat. Nos. 5,926,974, 6,018,889, 6,226,896 to Friton, U.S. Pat. No. 6,029,962 to Shorten, U.S. Patent Nos. 5,524,364, 4,577,417, 5,375,346, 5,545,463 and 5,416,986 to Cole, U.S. Pat. Nos. 5,664,341, 5,678,328, 5,679,439, 5,842,291 to Schmidt, and U.S. Pat. No. 5,794,359 to Jenkins.

If properly installed, a bladder may be effective in comforting the foot. However, the bladder also has a number of detriments that outweighs the effectiveness of the cushioning. First, the bladder is expensive to manufacture, and requires precision when the bladder is installed in the pocket of the shoe. If improperly and imprecisely installed in the pocket, the bladder may not cushion the foot.

Additionally, increased material costs must be borne by the manufacturer and consumer. These costs are attributed to forming the shoe with the bladder. Further, additional increased labor costs result. This increased labor costs are attributed to placing the bladder in the pocket at a precise pre-selected location of the pocket, which is time consuming, and sealing the pocket with the bladder in the correct pre-selected location of the pocket to facilitate cushioning.

The pocket must be formed with a similar size relative to the bladder in order for the bladder to fit therein and permit the bladder to appropriately expand and collapse to cushion the foot at the pre-selected location. These bladder installation operations are labor, and time intensive, and increase the cost of the shoe.

The bladder in the shoe has a first height in an inflated state and has a second height in a collapsed state. When running or walking, the bladder undergoes an impact. This impact causes the bladder to change its shape. This shape changes the bladder's height from the first height to the second height in a relatively short time interval. The foot rests on the bladder. When running or walking, this collapse in height may result in the foot in the shoe dropping suddenly from the first height to the second height upon impact with the ground. As such, the bladder creates an unstable sensation during impact.

SUMMARY OF THE INVENTION

It is an object of the present invention to provide a shoe that imparts cushioning without a bladder.

It is another object of the present invention to provide a number of passageways between outsole and midsole cavities that are formed as bulges to avoid possible blockage during production or use.

It is yet another object of the present invention to provide a shoe that is stable at point of impact and has a footwear system that imparts energy absorption to the foot upon impact.

It is still another object of the present invention to provide a footwear system with a midsole having a first cavity and a second cavity and an outsole having a ground contacting surface.

It is still yet another object of the present invention to provide a footwear system with the outsole connected to the midsole to define a first air bulge and a second air bulge extending outward from the ground contacting surface and with the first air bulge connected to the second air bulge by a passageway.

It is a further object of the present invention to provide an outsole made in a number of pieces to be applied to a midsole with a sole unit having a number of bulges and for the outsole and midsole connection process not to block any passageways formed between the bulges by the manufacturing process or by compression.

It is still a further object of the present invention to provide a number of bulges that extend the cushioning effect of bulges and passageways beyond the metatarsal region and into the toe region of a sole unit without having an extended portion that could potentially cause tripping.

It is yet a further object of the present invention to provide a stabilizing block about a heel of an outsole that extends beyond a periphery of the heel to improve leverage in ground contact.

It is another object of the present invention to provide a transparent shank to cover the passageways in the midsole at a midfoot region to reduce compression of the passageways and provide visibility to consumers.

The above and other advantages, objects, and benefits of the present invention will be understood by reference to the detailed description provided below and the accompanying drawings. The object, advantages, and benefits of the present invention listed above do not form limitations to the claimed invention.

DETAILED DESCRIPTION OF THE INVENTION

Figure 1:
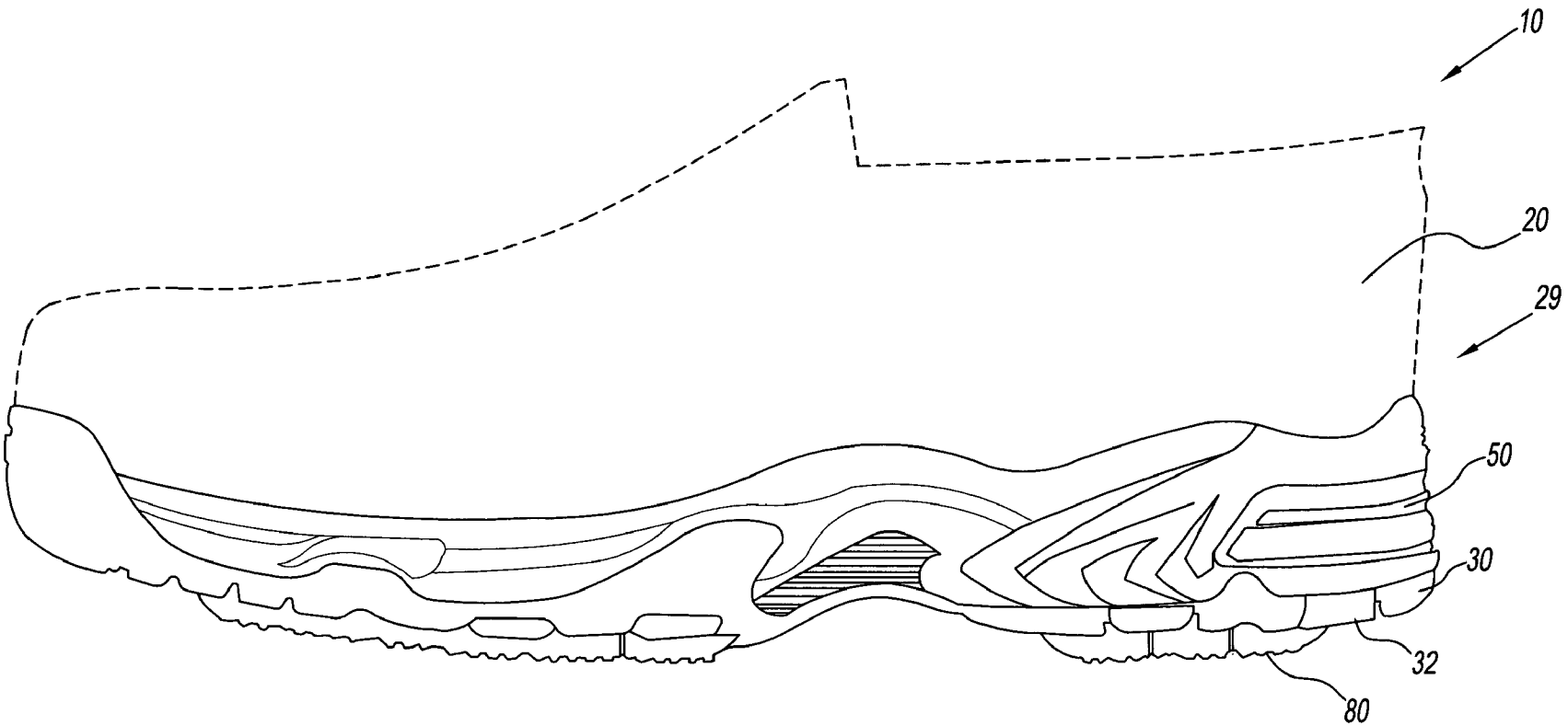
FIG. 1 is a side view of a shoe of the present invention.

Referring to the drawings and, in particular, FIG. 1, there is provided a shoe according to the present invention generally represented by reference numeral 10. The shoe 10 is shown as an athletic shoe. However, one skilled in the art should appreciate that the shoe may be any type of shoe known in the art, including but not limited to, a dress shoe, a boot, a cross training shoe, a running shoe, a sneaker, a flat, a high heeled shoe, an overshoe, a pump, a loafer, a moccasin, a padded sock, a slipper, or any other shoe for athletic, dress or comfort.

The shoe 10 has an upper 20 connected to a sole unit 29. The sole unit 29 is a combination of the midsole 50 and an outsole 30. The upper 20 is a portion of the shoe 10 covering a foot above the sole unit 29. The sole unit 29 has the ground contacting outsole 30 including a number of air bulges 80. The number of air bulges 80 extend toward the ground or groundwardly from the outsole 30. Preferably, the number of air bulges 80 are formed from both the midsole 50 and the outsole 30 and provide comfort and stability to the foot resting in the shoe. Each of the air bulges 80 have an amount of air disposed therein to allow the air to cushion a foot on the midsole 50 of the shoe 10. The air disposed in air bulges 80 is generally atmospheric pressure when unloaded.

Figure 2:
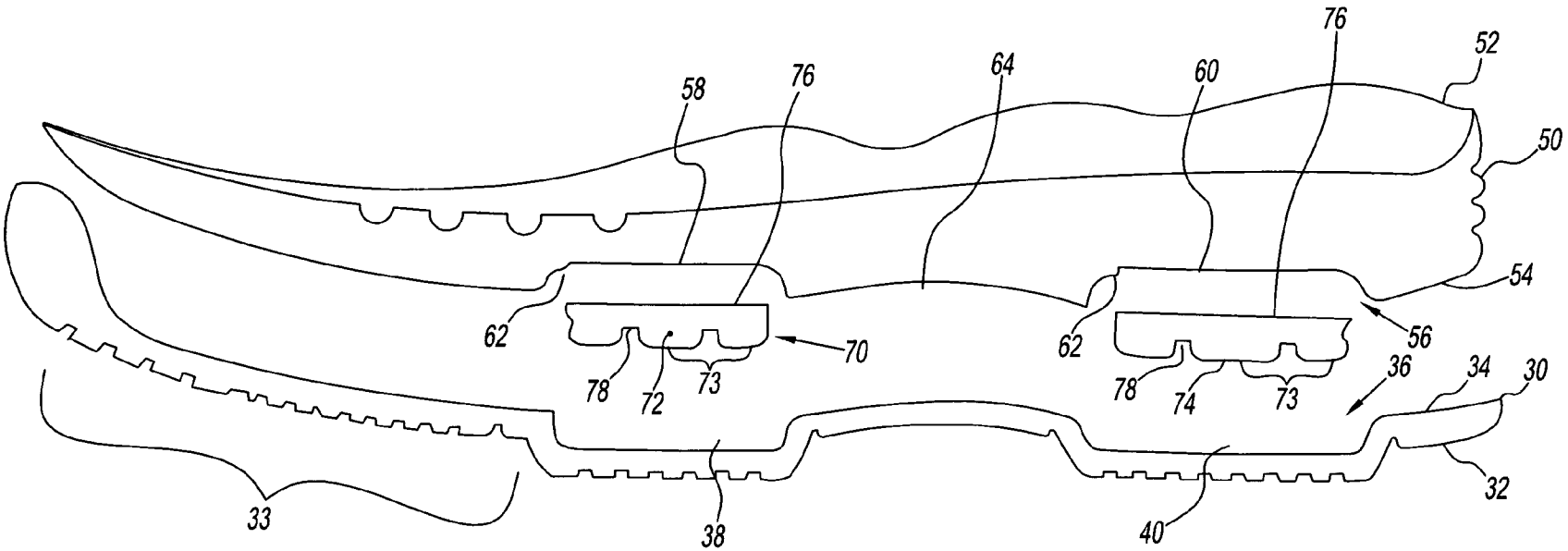
FIG. 2 is an exploded sectional view of a midsole, an outsole, and first and second inserts being between the outsole and the midsole of the shoe of FIG. 1.

Referring to FIG. 2, the midsole 50 is preferably a middle layer of the sole unit 29 for providing stability to the foot. Preferably, the midsole 50 has a shape that is complementary to the upper, but one skilled in the art should appreciate that the midsole may have any shape suitable for being between the foot and the outsole 30. The midsole 50 is preferably made of a molded ethyl-vinyl acetate. Less preferably, the midsole 50 may be made from a non-molded ethyl-vinyl acetate, a compressed ethyl-vinyl acetate, a thermoplastic rubber, a polyvinyl chloride, polyurethane, wood, or any combinations thereof. However, one skilled in the art should appreciate that the midsole 50 may be made of any suitable material known in the art.

The midsole 50 has a top surface, or foot facing surface 52, and a bottom surface or outsole facing surface 54 opposite the foot facing surface. The bottom surface 54 has therein a number of midsole air bulge cavities that are collectively designated as reference numeral 56. One skilled in the art should appreciate that the midsole 50 may have any number of midsole air bulge cavities 56 depending on an amount of cushioning desired by the designer. In one embodiment, the midsole 50 may be formed with a first midsole air bulge cavity 58 and a second midsole air bulge cavity 60. Referring to an inner surface of each midsole air bulge cavity 56, one will appreciate that each midsole air bulge cavity has a narrow shelf or ledge 62 on a wall of the midsole air bulge cavity. The midsole air bulge cavities 56 each have a depth suitable for receiving a member therein. The midsole 50 also has a midsole cavity channel 64 disposed on the bottom surface 54. The midsole cavity channel 64 connects the first midsole air bulge cavity 58 to the second midsole air bulge cavity 60 on the bottom surface 54 of the midsole 50.

Referring again to FIG. 2, the outsole 30 has a top surface 34 and the ground-contacting surface 32. Preferably, the outsole 30 is a rubber material and has a tread 33 disposed on the ground-contacting surface 32. The tread 33 may be any pattern known in the art for increasing friction formed on the ground contacting surface 32 including, but not limited to, a number of lateral striations, a number of longitudinal striations, a circular pattern, a number of protrusions, a number of pods, or any combinations thereof. Less preferably, the outsole 30 is a thermoplastic rubber, a polyvinyl chloride, a lightweight thermoplastic rubber, a polyurethane, EVA, or any combinations thereof.

The outsole 30 preferably has a number of outsole air bulge cavities that are collectively designated as reference numeral 36. One skilled in the art should appreciate that the outsole 30 potentially has any number of outsole air bulge cavities 36 depending on an amount of cushioning desired by the designer. Also, the number of outsole air bulge cavities 36 should be complementary in number to the number of midsole air bulge cavities 56. In a preferred embodiment, the outsole 30 has a first outsole air bulge cavity 38 and a second outsole air bulge cavity 40. One skilled in the art should appreciate that the number of outsole air bulge cavities 36 are complementary in position and in size to the number of midsole air bulge cavities 56.

Referring again to FIG. 2, the shoe 10 has a member connected to the midsole 50 in each of the midsole air bulge cavities 56. Preferably, the member imparts energy absorption to cushion the foot upon impact. Preferably, the member is a number of resilient inserts 70. The shoe 10 may have any number of resilient inserts 70, known in the art to be in each of the midsole air bulge cavities 56. In one embodiment, the shoe 10 has a first resilient insert 72 and a second resilient insert 74 both shown between the outsole 30 and the midsole 50. The first resilient insert 72 and the second resilient insert 74 each has a top surface 76 and a bottom surface 78 both formed from a resilient and durable material. Preferably, the first resilient insert 72 and the second resilient insert 74 are each formed from a polyurethane ethyl-vinyl acetate combination material. Less preferably, the first resilient insert 72 and the second resilient insert 74 may each be formed of a thermoplastic rubber, a lightweight thermoplastic rubber, polyvinyl chloride, polyurethane, or EVA, a lightweight polyvinyl chloride, or any combinations thereof. In another exemplary embodiment of the present invention, the first resilient insert 72 and the second resilient insert 74 may also be formed with a resin (not shown) being added therein. The resin preferably reduces an overall weight of the first resilient insert 72 and the second resilient insert 74. This reduces an overall weight of the shoe 10. A preferred example of the resin is polyvinyl chloride, however any suitable resin may be added to the first resilient insert 72 and the second resilient insert 74. Preferably, each of the first resilient insert 72 and the second resilient insert 74 has a tread pattern 73 on the bottom surface 78.

Preferably, the top surface 76 of the first resilient insert 72 is connected to the midsole 50 in the first midsole air bulge cavity 58, and the top surface 76 of the second resilient insert 74 is connected to the midsole 50 in the second midsole air bulge cavity 60. In one embodiment, the first resilient insert 72 is connected to the midsole 50 and rests on or adjacent to the ledge 62 of the first midsole air bulge cavity 58. Likewise, the second resilient insert 74 may be adjacent to or rests on the ledge 62 of the second midsole air bulge cavity 60.

Preferably, the first and the second resilient inserts 72, 74 are connected to the midsole 50 by an adhesive. However, one skilled in the art should appreciate that the first and the second resilient inserts 72, 74 may be connected to the midsole 50 by any method known in the art including, but not limited to, molding including injection molding, mechanical fasteners, or any other connectors known in the art. One skilled in the art should appreciate that upon manufacturing the shoe 10, care should be taken that the adhesive does not enter the midsole air bulge cavities 56 or the outsole air bulge cavities 36 during manufacture. Likewise to prevent the adhesive from entering the midsole air bulge cavities 56 or the outsole air bulge cavities 36 during manufacture, the outsole 30 may be formed in two or more pieces and placed over the midsole 50.

Figure 3:
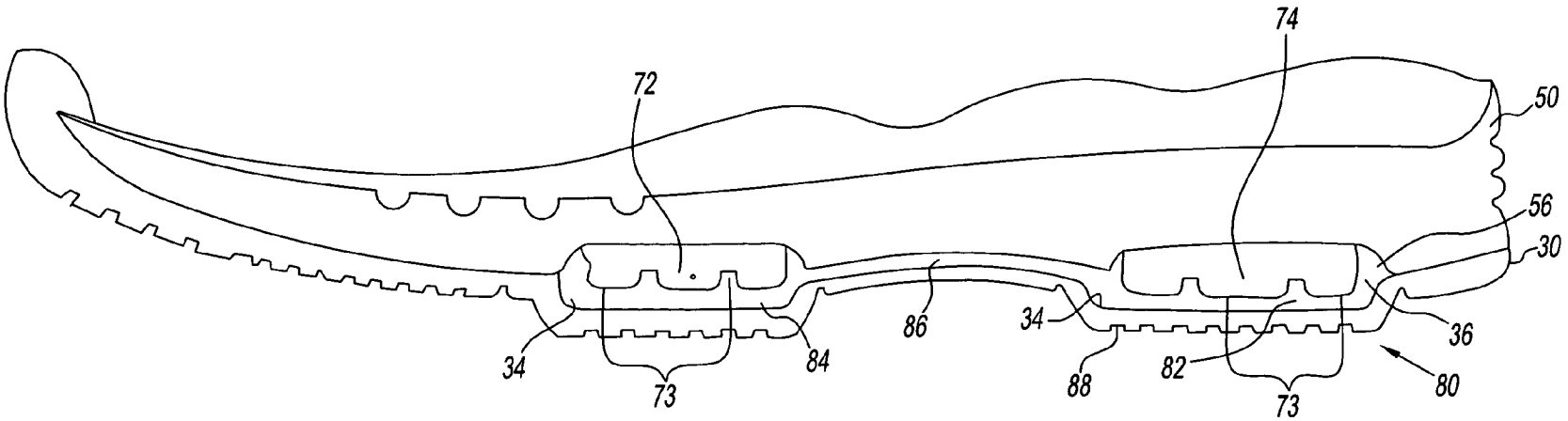
FIG. 3 is a side view of the midsole being connected to the outsole with the first and second inserts in the midsole of FIG. 2.

As shown in FIG. 3, the midsole 50 is preferably connected to the outsole 30 so that the midsole air bulge cavities 56 collectively are complementary to the outsole air bulge cavities 36 to form a number of air bulges 80. Air bulges 80 preferably are a first air bulge 82, a second air bulge 84 and a channel 86. The channel 86 connects the first air bulge 82 and the second air bulge 84, and is preferably located in the midsole 50. However, one skilled in the art should appreciate that any number of air bulges 80 may be formed in any number of regions of the outsole 30 and the midsole 50. The number of air bulges 80 may have any size or shape known in the art including a peanut shape, a triangular shape, a elliptical shape, a polyhedron shape, a polygon shape, rectangular, circular, or any combinations thereof.

An exemplary aspect of the first air bulge 82 and the second air bulge 84 is that upon impact the ground contacting surface 32 strikes the ground and causes the first air bulge 82, the second air bulge 84, or both, to deform and absorb energy of the impact imparted by ground. The number of air bulges 80 with the first resilient insert 72 and the second resilient insert 74 therein also provide stability. The first resilient insert 72 and the second resilient insert 74 upon impact provide energy absorption and support to the midsole 50, and accordingly the foot is supported by the midsole. This energy absorption provides for a beneficial stable sensation to the foot and overcomes deficiencies in the art. Moreover, the tread pattern 73 being on the first and second resilient inserts 72, 74 allows the first and second resilient inserts an amount of traction to grab onto the top surface 34 of the outsole 30 to increase control when running or walking.

Figure 4:
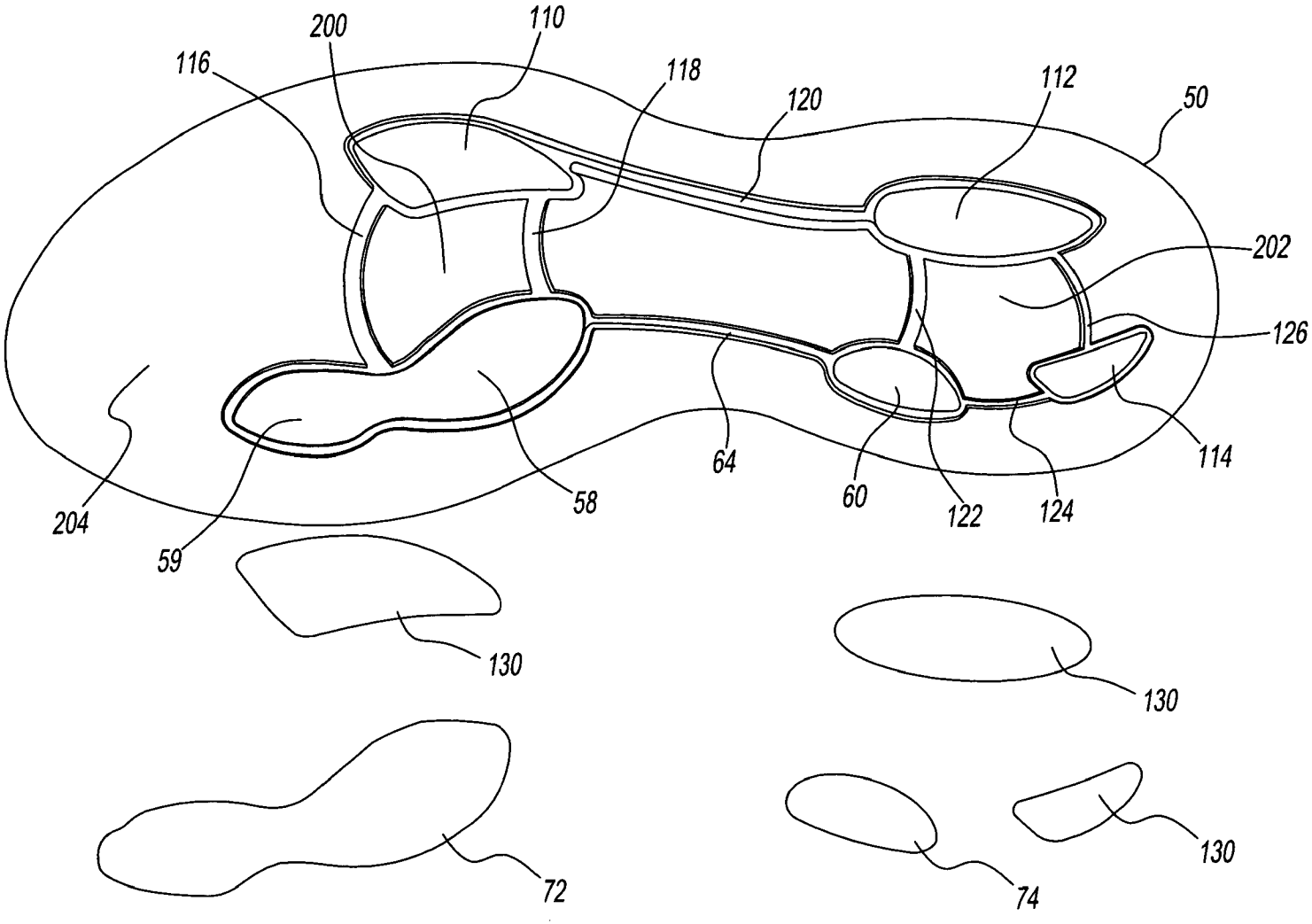
FIG. 4 is bottom exploded view of a midsole of another embodiment of the shoe of FIG. 1 with a number of inserts.
Figure 5:
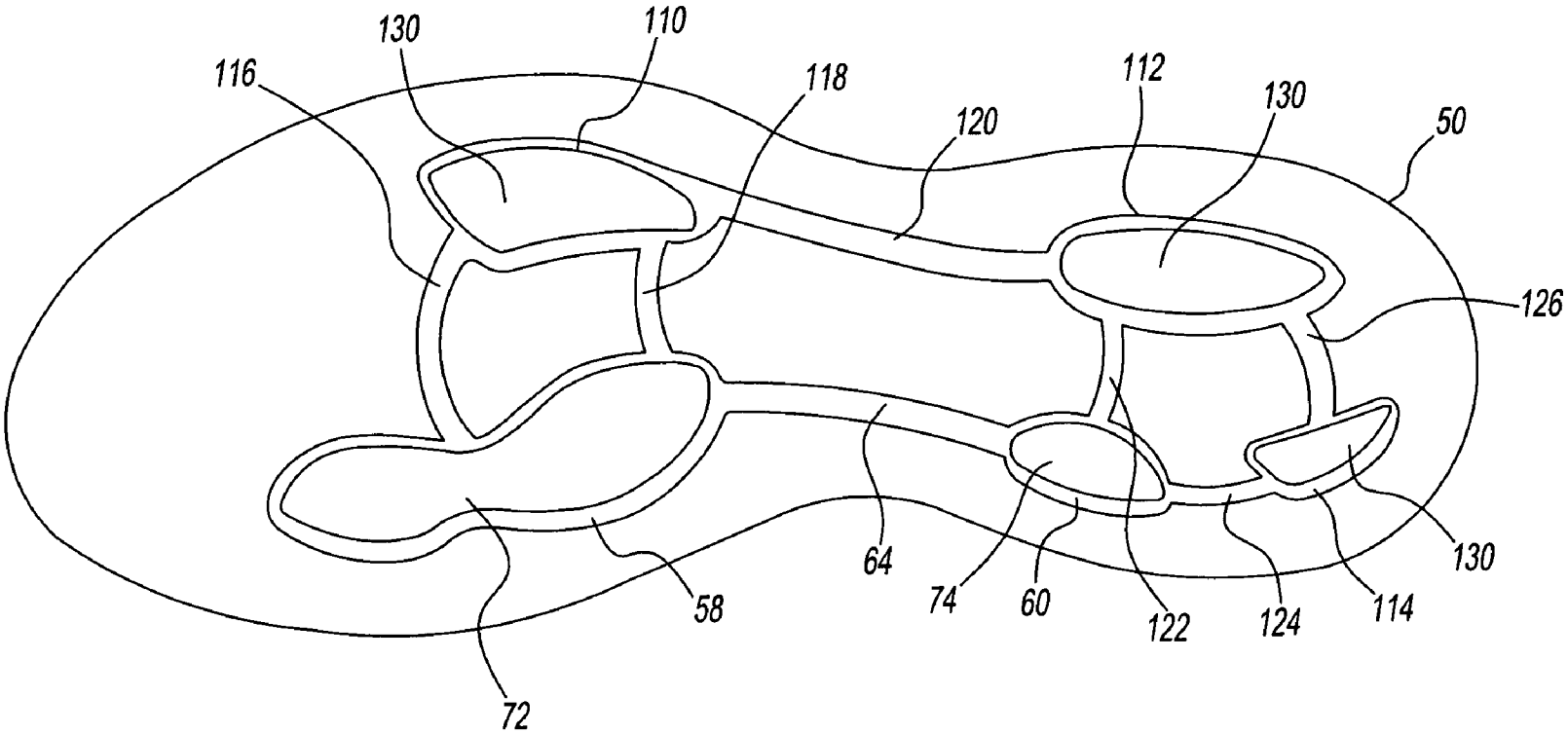
FIG. 5 is another bottom view of the midsole of FIG. 4 with the inserts being in the midsole.
Figure 6:
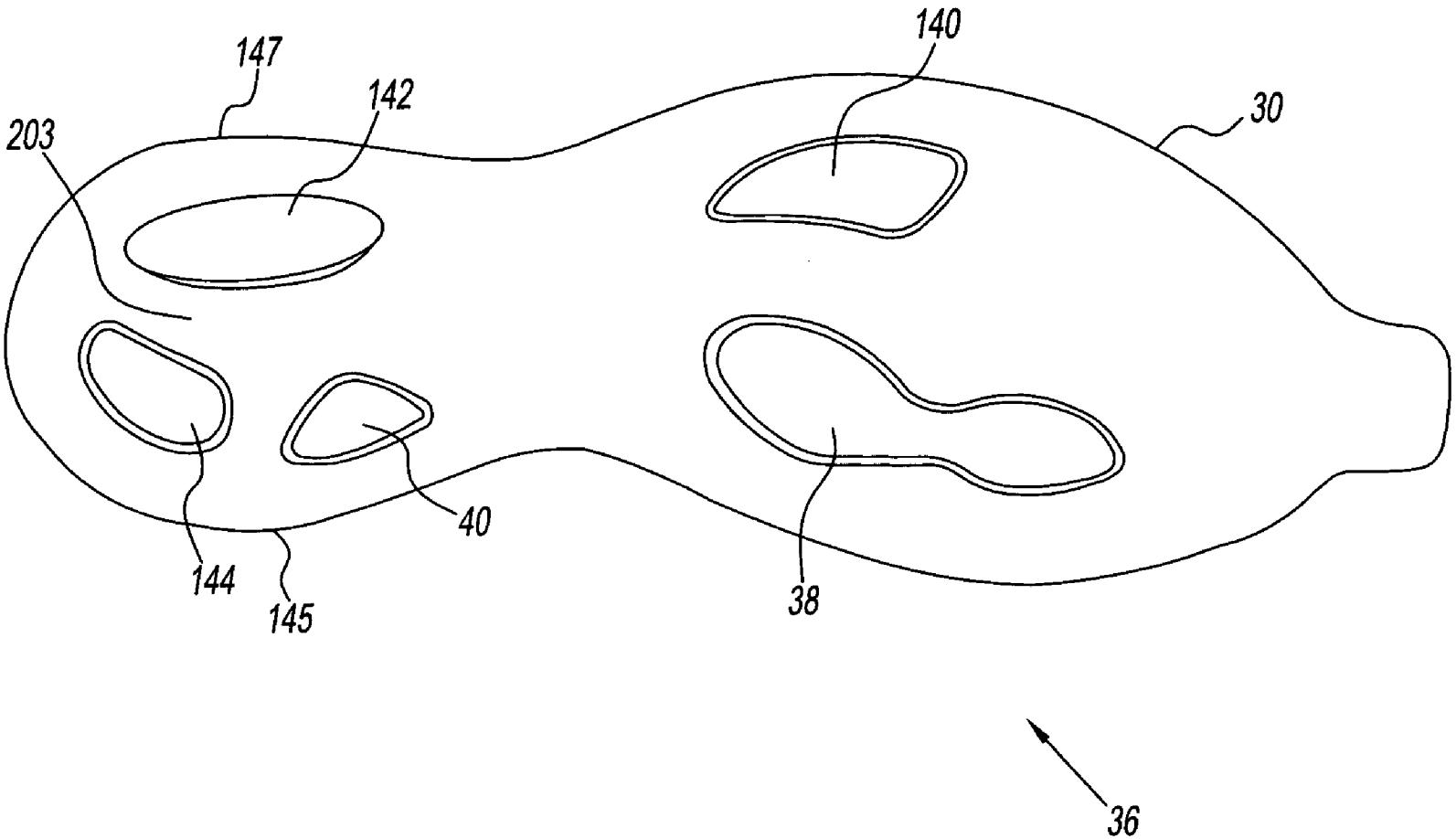
FIG. 6 is a top view of an outsole of FIG. 1.

Referring to another exemplary embodiment of the shoe 10 shown in FIGS. 4 through 6, the midsole 50 has the first midsole air bulge cavity 58, the second midsole air bulge cavity 60, and additional midsole air bulge cavities in a number of locations on the midsole 50. For example, the midsole 50 may have a third midsole air bulge cavity 110, a fourth midsole air bulge cavity 112, and a fifth air bulge cavity 114.

In this embodiment, the midsole 50 has the first midsole cavity channel 64. The first midsole cavity channel 64 connects the first midsole air bulge cavity 58 to the second midsole air bulge cavity 60. In this preferred embodiment, the midsole 50 also has a number of additional midsole cavity channels for connecting the additional midsole air bulge cavities in a number of locations on the midsole. For example, the midsole 50 has a second midsole cavity channel 116, a third midsole cavity channel 118, a fourth midsole cavity channel 120, a fifth midsole cavity channel 122, a sixth midsole cavity channel 124, and a seventh midsole cavity channel 126. One skilled in the art should appreciate that the midsole 50 may have any number of midsole cavity channels depending on the number of air bulges 80 desired.

In this embodiment, each midsole air bulge cavity 56 has a shape and is disposed in a position on the bottom portion 54 of the midsole 50. Preferably, the first through fifth midsole air bulge cavities 58, 60, 110, 112, 114 are disposed either under a metatarsal region 200 under a toe region 204 or under a heel strike region 202 or any combinations thereof. Preferably, the first and the third midsole air bulge cavities 58, 110, respectively, are disposed in the metatarsal region 200. The second, fourth, and fifth midsole air bulge cavities 60, 112, 114 are in the heel strike region 202. The first midsole air bulge cavity 58 extends under toe region 204 in a cavity portion 59 of the first midsole air bulge cavity.

Preferably, the second and third midsole cavity channels 116, 118 connect the first midsole air bulge cavity 58 to the third midsole air bulge cavity 110. The fourth midsole cavity channel 120 connects the third midsole air bulge cavity 110 to the fourth midsole air bulge cavity 112. The fifth midsole cavity channel 122 connects the second midsole air bulge cavity 60 to the fourth midsole air bulge cavity 112. The sixth midsole cavity channel 126 connects the fifth midsole air bulge cavity 114 to the fourth midsole air bulge cavity 112. The seventh midsole cavity channel 124 connects the second midsole air bulge cavity 60 to the fifth midsole air bulge cavity 114.

Preferably, each of the first through fifth midsole air bulge cavities 58, 60, 110, 112, 114 have one or more different shapes to impart comfort to the foot resting on the midsole 50. The first midsole air bulge cavity 58 has a substantially peanut shape, or shape of a numeral eight with the cavity portion 59. Preferably, the first midsole air bulge cavity 58 has a portion of the first midsole air bulge cavity in the metatarsal region 200 and cavity portion 59 in a toe region 204 of the midsole 50. In this manner, comfort is imparted to both the metatarsal and the toe of the foot resting comfortably on the midsole 50.

The second midsole air bulge cavity 60 preferably has a substantially triangular shape. The second midsole air bulge cavity 60 is in the heel strike region 202. The third midsole air bulge cavity 110 preferably also has a triangular shape. The third midsole air bulge cavity 110 is located in the metatarsal region 200 of the midsole 50. The fourth midsole air bulge cavity 112 preferably has a substantially elliptical shape and is in the heel strike region 202 of the midsole. The fifth midsole air bulge cavity 114 preferably has a triangular shape and is in the heel strike region 202 of the midsole. However, one skilled in the art should appreciate that the midsole air bulge cavities 58, 60, 110, 112, 114 may have any suitable shape and size known in the art and may be disposed in any suitable location on the midsole 50 to provide comfort to the user.

Referring again to FIG. 4, the shoe 10 has the first resilient insert 72, the second resilient 74, and a number of additional resilient inserts 130 below the midsole 50. Each of the first, second, and additional resilient inserts 72, 74, 130 has a complementary shape to be connected to the midsole 50 in the first through fifth midsole air bulge cavities 58, 60, 110, 112, and 114.

Referring to FIG. 5, each of the first resilient insert 72, the second resilient 74, and a number of additional resilient inserts 130 are in the first through fifth midsole air bulge cavities 58, 60, 110, 112, and 114 as shown. Preferably, each of the first, second, and additional resilient inserts 72, 74, 130 have the tread pattern 73 disposed thereon.

Referring to FIG. 6, the outsole 30 has a number of outsole air bulge cavities 36. Preferably, in this embodiment, the outsole 30 has five outsole air bulge cavities 36. However, one skilled in the art should appreciate that the outsole 30 has the same number of outsole air bulge cavities 36 as the number of the first, second, and additional resilient inserts 72, 74, 130. Preferably, the outsole air bulge cavities 36 are arranged to be complementary in shape and size relative to the first, second, third, fourth and fifth midsole air bulge cavities 58, 60, 110, 112, 114 of midsole 50 shown in FIG. 5. As mentioned, the outsole 30 preferably has the first outsole air bulge cavity 38, the second outsole air bulge cavity 40, a third outsole air bulge cavity 140, a fourth outsole air bulge cavity 142, and a fifth outsole air bulge cavity 144.

Referring again to an outsole heel region 203 shown in FIG. 6, the outsole heel region has a medial aspect 145 and a lateral aspect 147. The fifth outsole air bulge cavity 144 and the second outsole heel bulge cavity 40 are oriented on the medial aspect 145 of the outsole heel region 203. However, one skilled in the art should appreciate that the fifth outsole air bulge cavity 144 and the second outsole heel bulge cavity 40 may be oriented in any suitable location thereon. Preferably, the fourth outsole heel bulge cavity 142 is oriented on the lateral aspect 147 of the outsole heel region 203. Likewise, one skilled in the art should appreciate that the fourth outsole heel bulge cavity 142 may be disposed in any suitable location thereon.

In an alternative embodiment of the present invention, the outsole 30 may have a number of outsole cavity channels (not shown) or relatively narrow conduits for connecting the outsole air bulge cavities with one another, and further may be disposed complementary with the midsole cavity channel 64. One skilled in the art should appreciate that any number of channels may be used and is within the scope of this alternative embodiment.

Figure 7:
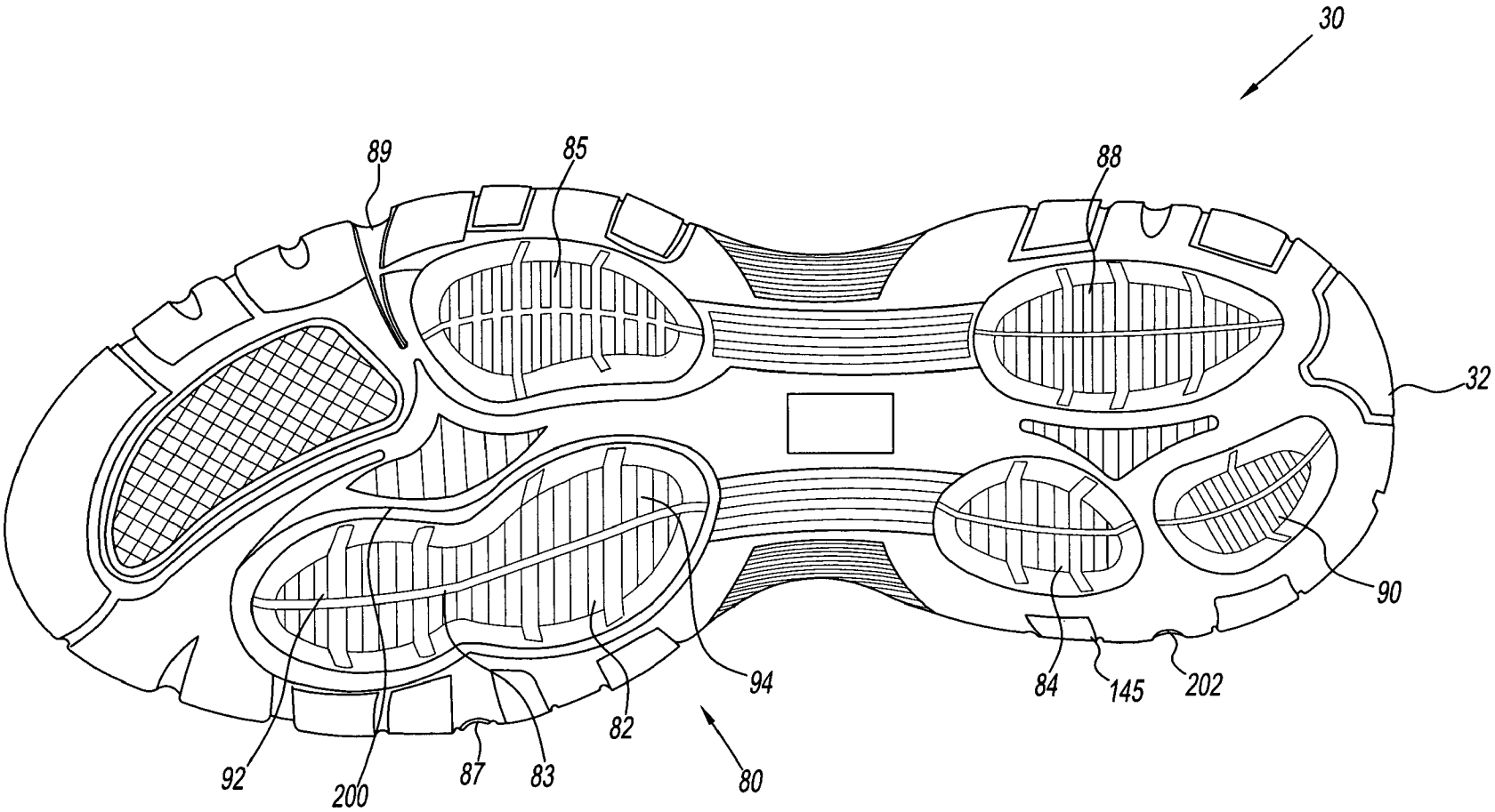
FIG. 7 is a bottom view of the outsole of the shoe of FIG. 6 being connected to the midsole of FIG. 5.

Referring to FIG. 7, air bulges 80 are formed when the outsole 30 of FIG. 6 is connected to the midsole 50 of FIG. 5. Preferably, each of the air bulges 80 depends groundward from the ground contacting surface 32 a desired amount to provide cushioning to the foot. In this preferred embodiment, five air bulges are formed, namely the first air bulge 82, the second air bulge 84, a third air bulge 85, a fourth air bulge 88, and a fifth air bulge 90. However, one skilled in the art should appreciate that the shoe 10 may be formed with any number of air bulges 80 greater than two to provide comfort and stability to at least the metatarsal region 200 and the heel strike region 202.

Each of the air bulges 80 has a length to insert volume ratio. The greater the length to insert volume ratio of the relatively smaller diameter air bulges tends to add rigidity. This rigidity is used to add medial shoe stability by the provision of second air bulge 84 and fifth air bulge 90 on the medial aspect 145 of the outsole 30. Preferably, the formation of three air bulges, shown as the fourth air bulge 88, the second air bulge 84, and the fifth air bulge 90 is beneficial and provides comfort to the wearer. Additionally, the first air bulge 82 has a narrow portion 83. The narrow portion 83 is preferably aligned with notches or preferably first and second flex notches 87, 89 on lateral sides of the shoe 10. The first and second flex notches 87, 89 are aligned with a mid-portion of the first air bulge 82 that is shown as peanut shaped. The first and the second flex notches 87, 89 improve the flexibility of the outsole 30. One skilled in the art should appreciate that any number of flex notches may be used and is within the scope of the present invention.

In another exemplary embodiment, the first and second flex notches have an axis of alignment that intersects a longitudinal axis of the footwear system at an angle that is less than ninety degrees.

In another exemplary embodiment of the present invention, the first air bulge 82 may have a toe portion 92 with a first height, and a metatarsal portion 94 with a second height. The first height is preferably less than the second height. The height is measured from opposite the ground contacting surface 32 of the outsole 30 to a ground-contacting surface of the respective air bulge 80. This allows the user to more comfortably walk or run. The toe portion 92 may catch the ground and drag the foot after impact with the ground. This drag by the toe portion 92 may slightly impede the following stride of the foot. Accordingly, it is within the scope of the present invention to form the toe portion 92 to reduce this dragging on the ground and prevent the toe portion from impeding the next stride of the user when walking or running.

Figure 8:
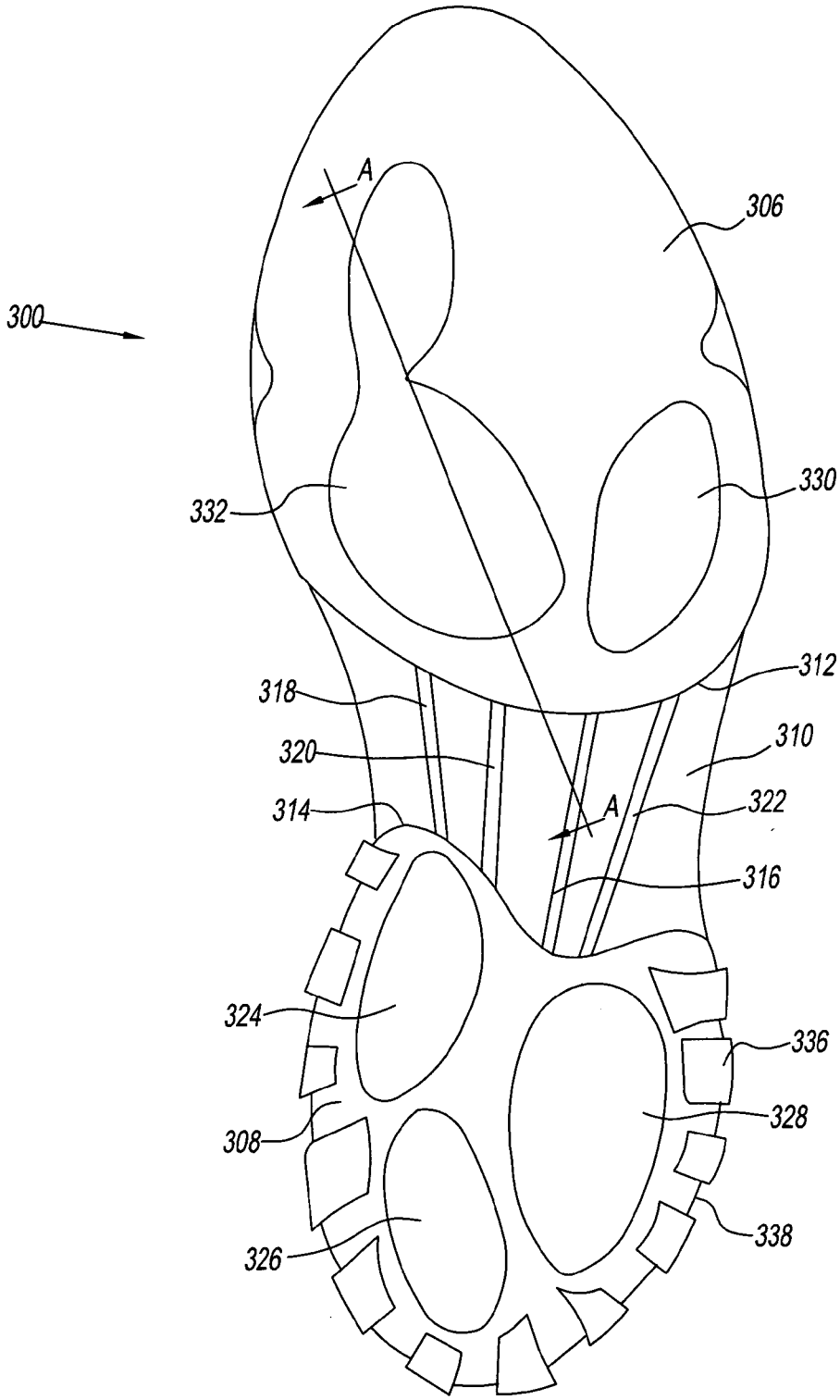
FIG. 8 is a bottom view of a sole unit of an alternative embodiment of the present invention.
Figure 9:
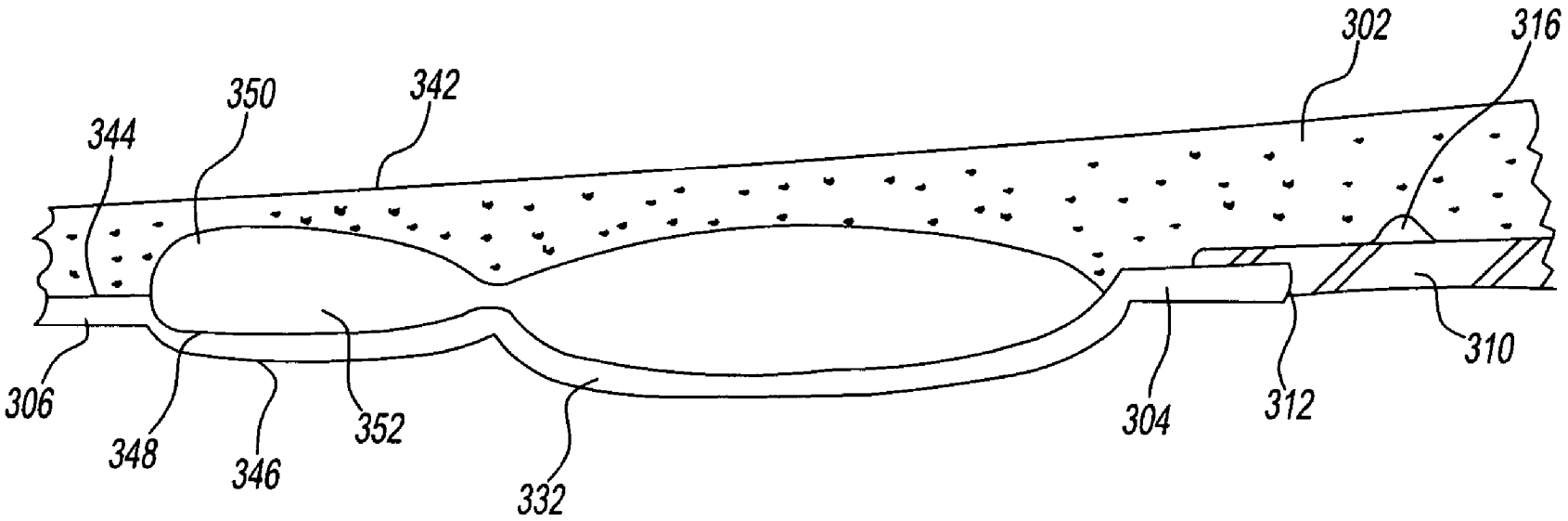
FIG. 9 is a cross-sectional view of the sole unit of FIG. 8 taken along line A—A of FIG. 8.
Figure 10:
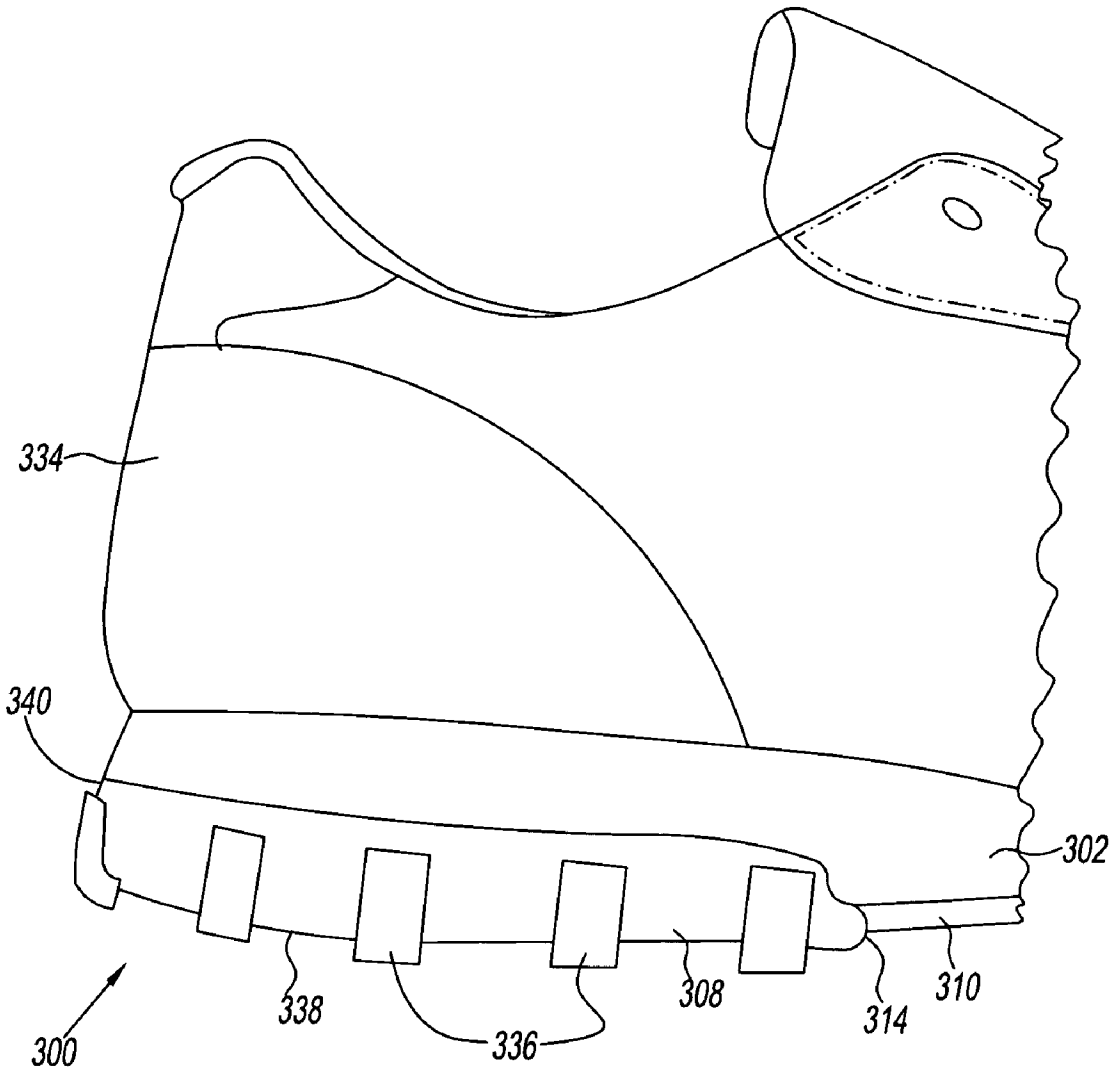
FIG. 10 is an exterior side view of a heel part of the shoe having the sole unit of FIG. 8.

Referring to FIGS. 8 through 10, there is shown another exemplary embodiment of the present invention. In this embodiment, the wearer or others have the ability to be able to visibly peer into one or more portions of the sole unit 300. The sole unit 300 has a midsole 302 with a wearerward or towards the foot of a wearer's foot surface 342 and a groundward surface 344. The sole unit 300 also has an outsole 304 with a groundward surface 346 and a wearerward surface 348. The sole unit 300 also has a forefoot outsole portion 306 and a heel outsole portion 308. Any desirable form of upper 334 may be used for holding the sole unit 300 in place on a wearer's foot (not shown). An exemplary aspect of the present invention is that the sole unit 300 has a shank plate 310. The shank plate 310 is preferably lapped under a rear edge 314 of the heel outsole portion 308. The shank plate 310 forms an airtight seal for a midsole passageway 316. Additional midsole passageways 316, 318, 320, 322 are shown. However, these are an optional feature of the shoe 10 of the present invention. At least one of the midsole passageways 316, 318, 320, and 322 connects outsole heel air bulges 324, 326 and 328 to outsole forefoot air bulges 330 and 332. This connection through the midsole passageway 316 permits air to move between the outsole heel air bulges 324, 326, 328 and the outsole forefoot air bulges 330, 332. This is by direct connection of the outsole heel air bulges or by having other midsole passageways (not shown) connect between the outsole heel air bulges 324, 326, and 328. In the same way, the outsole forefoot air bulges 330 and 332 can be directly connected to the midsole passageway 316 or indirectly connected by other midsole passageways (not shown) to permit the flow of air during use of the shoe, for example by running or walking.

The shank plate 310 can be transparent, translucent, opaque or have any other clear appearance. The shank plate 310 can also, at least in some areas, overlie midsole passageways 316, 318, 320, and 322 and permit the desirable effect of making the midsole passageways visible. The shank plate 310 can also be opaque and still function, just as the shank plate can have additional features and ornamentation. This ornamentation is selectively added at the choice of the designer. This ornamentation of the shank plate 310 does not reduce the utility of the shoe 10 provided that the shank plate performs the task of sealing the midsole passageways 316, 318, 320, and 322 against loss of air to ambient. The shank plate 310 can be made of a polymer, thermoplastic polyurethane, polyurethane, polyvinyl chloride, Pebax® plastic, Hytrel® thermoplastic elastomer, Surlyn® or other materials known in the art to be generally impervious to air leakage.

Referring to FIG. 9, the outsole heel air bulges 324, 326, 328 and outsole forefoot air bulges 330, 332 correspond to a number of corresponding midsole air cavities as shown. The midfoot midsole air cavity 350 is shown in cross section in FIG. 9. The combination of midsole air cavity 350 and the respective outsole air bulge forms an air pocket 352. The air pocket 352 is preferably between the outsole 304 and the midsole 302. The air pocket 352 contains more air relative to the instance where the outsole air bulge 332 or midsole air cavity 350 existed alone. Thus, the air pocket 352 adds to the amount of air available to be moved through air passageway 316 during use of the shoe and thus adds cushioning. In another exemplary embodiment of the present invention, the number of resilient inserts 70 can be placed in the one or more outsole heel air bulges 324, 326, 328 and/or the outsole forefoot air bulges 330, 332.

In another exemplary embodiment of the present invention shown in FIG. 10, the heel outsole portion 308 of the shoe 10 has a number of tread blocks 336. The tread blocks 336 preferably extend over an outsole lower perimeter 338 of the heel outsole portion 308. Preferably, the tread blocks 336 add stability to the shoe 10. In still another exemplary embodiment of the present invention, the tread blocks 336 can be formed in a suitable manner to wrap on a side wall 340 of the heel outsole portion 308 that is in a wearerward location in a location upward opposite the ground and toward the midsole 302. In this manner, the tread blocks 336 provide stability during the walking and/or running.

It should be understood that the foregoing description is only illustrative of the present invention. Various alternatives and modifications can be devised by those skilled in the art without departing from the invention. Accordingly, the present invention is intended to embrace all such alternatives, modifications and variances as embraced by the appended claims.

What is claimed is:

1. A footwear system comprising:

a midsole having a first cavity and a second cavity;

an outsole having a ground contacting surface, said outsole having a third cavity and a fourth cavity, said outsole being connected to said midsole so that said first cavity is complementary to said third cavity to define a first air bulge and said second cavity is complementary to said fourth cavity to define a second air bulge, said first air bulge and said second air bulge extending outward from said ground contacting surface, said first air bulge being connected to said second air bulge by a passageway;

a first resilient insert disposed in said first cavity and a second resilient insert disposed in said second cavity, said first and second resilient inserts providing an energy absorption to said midsole upon impact, wherein said first resilient insert and said second resilient insert each has a tread, said tread contacting an inner surface of said outsole upon impact to provide traction to said midsole, said inner surface being opposite said ground contacting surface, wherein said tread is a plurality of longitudinal grooves extending on a first surface opposite said midsole.

2. The footwear system of claim 1, wherein said passageway is in said midsole, said passageway allowing a fluid to traverse therethrough.

3. The footwear system of claim 1, further comprising a second tread being disposed on said ground contacting surface on said first air bulge and said second air bulge.

4. The footwear system of claim 1, wherein said first resilient insert and said second resilient insert are formed of a material selected from the group consisting of a polyurethane, an ethyl-vinyl acetate, a thermoplastic rubber, polyvinyl chloride, and any combinations thereof.

5. The footwear system of claim 1, further comprising a shank plate for sealing said passageway.

6. The footwear system of claim 5, wherein said shank plate is transparent for viewing said sealed passageway through said outsole.

7. The footwear system of claim 6, wherein said outsole is a first outsole portion and a second outsole portion, said first outsole portion and said second outsole portion being connected to one another, said first outsole portion and said second outsole portion being positioned over said sealed passageway to form said outsole.

8. The footwear system of claim 1, wherein said outsole is connected to said midsole by an adhesive.

9. The footwear system of claim 1, wherein said midsole is selected from the group consisting of an ethyl-vinyl acetate, a thermoplastic rubber, a polyvinyl chloride, polyurethane, and any combinations thereof.

10. The footwear system of claim 1, wherein said outsole is formed of a material selected from the group consisting of a thermoplastic rubber, a polyvinyl chloride, a lightweight thermoplastic rubber, a polyurethane, ethyl-vinyl acetate, and any combinations thereof.

11. The footwear system of claim 1, wherein said first air bulge and said second air bulge each have a shape selected from the group consisting of a peanut, a triangle, an ellipse, a polyhedron, a polygon, a circular shape, and any combinations thereof.

12. The footwear system of claim 1, wherein said first air bulge is disposed under a metatarsal region and a toe region of the footwear system.

13. The footwear system of claim 1, wherein said second air bulge is disposed under a heel strike region of the footwear system.

14. A shoe comprising:

a midsole having a plurality of first cavities with at least one of said plurality of first cavities being in a metatarsal region of said midsole and at least another one of said plurality of first cavities being in a heel strike region of said midsole;

an outsole having a ground contacting surface with a tread and having a plurality of second cavities, wherein said outsole is connected to said midsole so that said plurality of first cavities are complementary to said plurality of second cavities to define a plurality of air bulges extending outwardly from said ground contacting surface, said plurality of air bulges being interconnected by a plurality of passageways in said midsole; and a plurality of inserts connected to said midsole in each of said plurality of first cavities, said plurality of inserts each having a tread thereon, wherein said tread is a plurality of longitudinal grooves extending on a first surface opposite said midsole.

15. The shoe of claim 14, wherein at least one of said plurality of air bulges has a peanut shape, said at least one of said plurality of air bulges extending from said metatarsal region of said foot to a toe region of said foot.

16. The shoe of claim 14, wherein said plurality of first passageways in said midsole define a plurality of air channels connecting said plurality of air bulges to one another, wherein said plurality of air channels and said plurality of air bulges have air that traverses under said metatarsal region and said heel strike.

17. The shoe of claim 14, further comprising a plurality of inserts connected to said midsole in each of said plurality of first cavities, wherein said plurality of inserts absorb energy upon impact.

18. The shoe of claim 14, wherein at least one of said plurality of air bulges has a shape selected from the group consisting of a triangle, an ellipse, a polygon, and any combinations thereof.

19. The shoe of claim 14, wherein at least one said plurality of air bulges has a peanut shape, a top surface, and has a first height in said metatarsal region and a second height and in a toe region, said first and said second heights being measured from said ground contacting surface of said outsole to said top surface, said first height being greater than said second height, wherein said peanut shaped air bulge does not contact ground at said second height when striding.

20. The shoe of claim 14, wherein at least one of said plurality of air bulges in said metatarsal region of said midsole has a toe portion extending outwardly from said ground contacting surface.

21. The shoe of claim 20, wherein said toe portion has a lesser groundward extent relative to at least one of said plurality of air bulges in a midfoot portion of said outsole extending outwardly from said ground contacting surface.

22. The shoe of claim 20, wherein said at least one of said plurality of air bulges in said metatarsal region of said midsole has a narrow portion.

23. The shoe of claim 22, further comprising a flex notch in said outsole, said flex notch being aligned with said narrow portion.

24. The shoe of claim 14, further comprising a plurality of stability blocks, said plurality of stability blocks extending beyond a perimeter of said ground contacting surface of said outsole.

25. The shoe of claim 24, wherein at least one of said plurality of stability blocks is on a sidewall of said outsole.

26. A footwear system comprising:

a midsole having a first cavity and a second cavity;

an outsole having a ground contacting surface, said outsole having a third cavity and a fourth cavity, said outsole being connected to said midsole so that said first cavity is complementary to said third cavity to define a first air bulge and said second cavity is complementary to said fourth cavity to define a second air bulge, said first and second air bulges extending outward from said ground contacting surface, said first air bulge being connected to said second air bulge by at least two separate and independent passageways; and a pair of flex notches on the peripheral edge of said outsole, said pair of flex notches having an axis of alignment across a contricted portion of at least one of said first and second air bulges.

27. The footwear system of claim 26, wherein said axis of alignment and a longitudinal axis of the footwear system form a less than ninety degree angle.

* * * * *